United States Patent [19]

Dahowski

[11] Patent Number: 4,457,119

[45] Date of Patent: Jul. 3, 1984

[54] SWIMMING POOL COPING

[75] Inventor: Donald E. Dahowski, York, Pa.

[73] Assignee: Fox Pool Corporation, York, Pa.

[21] Appl. No.: 235,224

[22] Filed: Feb. 17, 1981

[51] Int. Cl.[3] ..... E04H 3/16

[52] U.S. Cl. ..... 52/300; 4/488; 4/498; 4/499; 4/506; 4/507

[58] Field of Search ..... 52/169.7, 300.0; 4/488, 4/498, 499, 503, 510

[56] References Cited

U.S. PATENT DOCUMENTS

| | | | |
|---|---|---|---|
| Re. 27,699 | 6/1973 | Rozanski . | |
| 3,239,975 | 3/1966 | Stier . | |
| 3,310,814 | 3/1967 | Lipman . | |
| 3,427,663 | 2/1969 | O'Connell et al. . | |
| 3,511,002 | 5/1970 | Fox | 52/300 |
| 3,628,198 | 12/1971 | Katzman | 4/172.21 |
| 3,667,071 | 6/1972 | Hoch et al. . | |
| 3,750,197 | 8/1973 | Weir et al. . | |
| 3,785,099 | 1/1974 | Greene . | |
| 3,906,688 | 9/1975 | Witte | 52/152 |
| 3,938,199 | 2/1976 | Laven . | |
| 4,004,386 | 1/1977 | Diffenderfer | 52/300 |
| 4,158,244 | 6/1979 | Stefan . | |

FOREIGN PATENT DOCUMENTS

| | | | |
|---|---|---|---|
| 2051572 | 1/1981 | United Kingdom | 52/169.7 |

*Primary Examiner*—Alfred C. Perham

[57] ABSTRACT

A flexible easily installed and low maintenance swimming pool coping providing the transitional element between horizontal pool deck and the vertical pool wall. The coping is provided with upper and lower horizontal channels and has a depending bifurcated lower end and is secured at the pool by slipping the bifurcated part over the top of the pool wall. A pool liner bead is accommodated in the lower channel and a decorative protective or functional insert is retained in the upper channel. The coping cross section is formed to permit it to be readily flexed around small radii in either direction for various pool profiles. A yoke with an interlock is provided for insertion at any desired location into the interior of the coping crown to prevent buckling or distortion of the crown. An interlocking leveling element to retain contiguous sections of the coping in alignment is also provided for insertion within the coping.

12 Claims, 12 Drawing Figures

FIG. 1
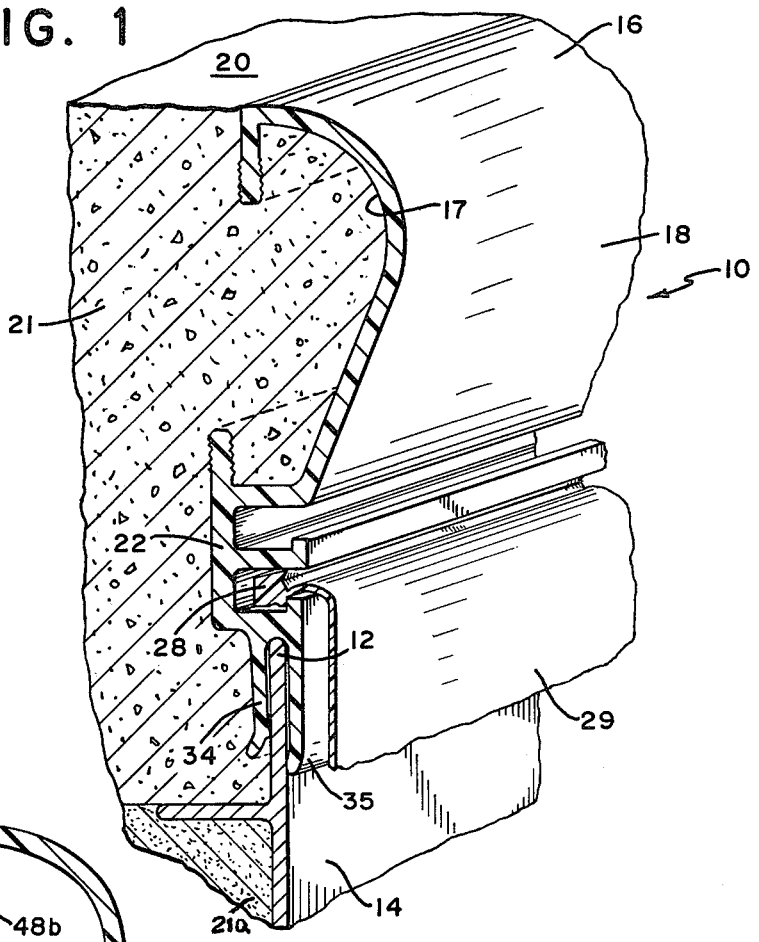
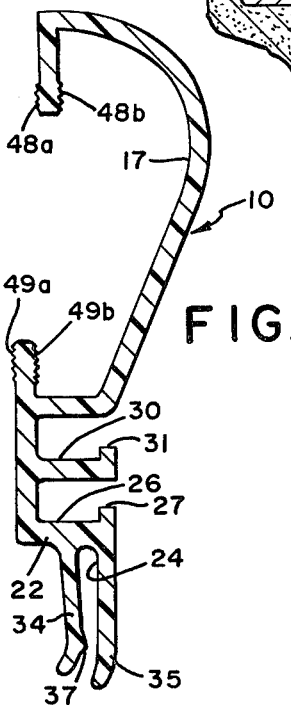
FIG. 2
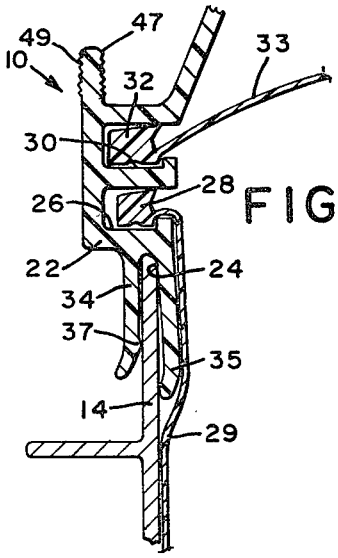
FIG. 3

FIG. 5
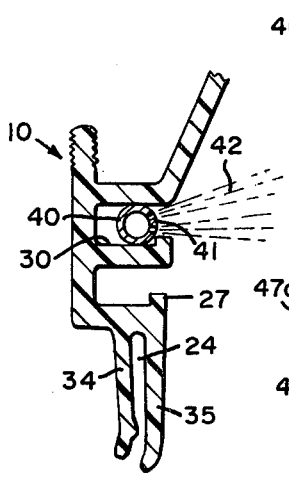
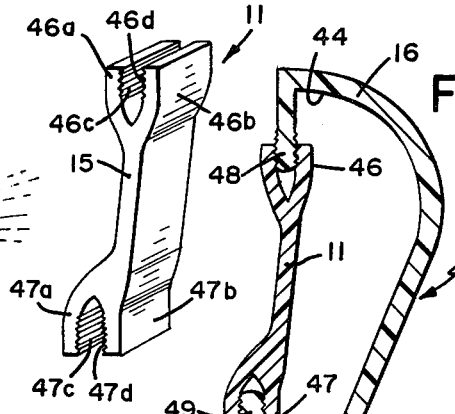
FIG. 4
FIG. 5A
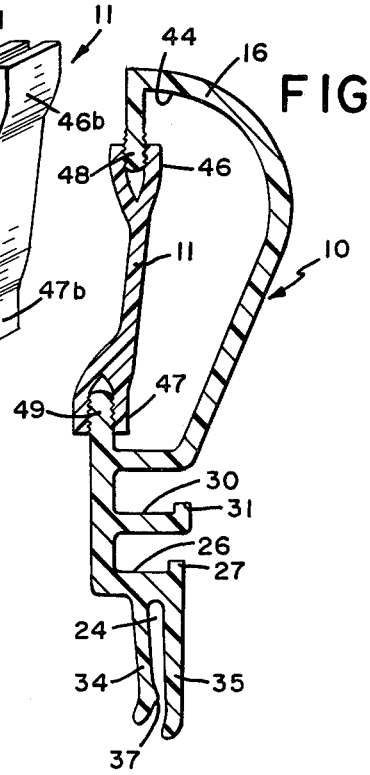
FIG. 6
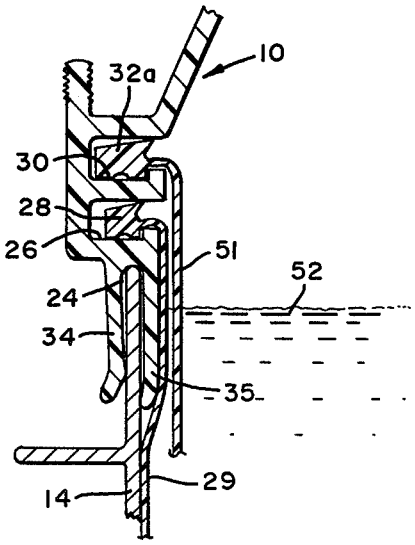
FIG. 7
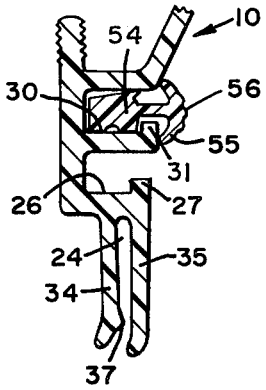

SWIMMING POOL COPING

BACKGROUND OF THE INVENTION

1. Field of the Invention

This invention relates to swimming pool construction and, more particularly, to a coping structure which is used to cap the upper edge of the wall of a swimming pool. In many modern swimming pools, the coping, which is usually formed of a plastic composition, comprises the transitional element or corner piece between the vertical pool wall and the horizontal deck and also serves to provide a mechanism to retain in place the upper peripheral bead of the vinyl liner.

The coping is a most important element in a swimming pool structure particularly in a below ground swimming pool. It is essential to have a reliable and durable coping and important, also, that the coping be easily secured and embody a variety of functions including a reliable attaching means for the vinyl liner in pools that use a liner, and to attach other accessories. The coping is subject to much use and frequent abuse because it is invariably stepped on, jumped on, often abused by equipment carried in or near the pool by those using the pool and often bumped by equipment used in servicing the pool. Because of its prominent position just above and surrounding the pool surface, the coping is always in view by those in the vicinity of the pool and, therefore, should present a neat and undistorted appearance.

2. Description of the Prior Art

It is known that a wide variety of swimming pool copings are in use including stone, tile, concrete, metal and plastic, each of which is secured to the deck and/or wall of the pool by a variety of mechanisms including mechanical attachment, adhesive or by being retained with poured concrete. Illustrative prior art copings, for example, are those disclosed by U.S. Pat. Nos. 3,239,975; 3,310,814; 3,427,663; 3,628,198; 3,667,071; 3,750,197; 3,785,099, RE 27,669 and 4,158,244.

While prior art copings, including those disclosed in the above patents, have been available in rigid, semi-rigid, and flexible compositions, invariably such copings have either been too cumbersome and have required substantial work to install on the pool on the one hand, or, in the case of a lighter weight construction, copings of the prior art have had a tendency to distort and present an unsightly shoddy appearance. There is, accordingly, a need for a coping which is readily installed, which affords definite advantages of versatility, which presents an undistorted appearance and promotes maintenance of the swimming pool and which supplies a convenient means for the attachment of a plurality of protective and functional accessories for the pool.

SUMMARY OF THE INVENTION

The objects of the invention reside in providing a swimming pool coping which, because of its novel cross section configuration, wall thickness and semi-flexible composition, enables it to be readily flexed, fitted, secured and strengthened in place and adapted for use with a variety of differently contoured swimming pool shapes and to follow both concave and convex directions around the pool, including the relatively sharp corners of rectangular pools.

The coping configuration of the present invention comprises a vertical downward facing installation groove which receives therein the top of the vertical wall of a prefabricated in-ground swimming pool. Such pools are formed, most conventionally, of a plurality of contiguously joined panels or modules of sheet metal, although such panels may also be formed of other materials such as plastic or fiberglass composition, for example. The coping is provided with a pair of integrally formed horizontally disposed grooves facing the interior of the pool. The lower horizontal groove receives the peripheral bead of a flexible swimming pool liner which is usually formed of vinyl polymer composition. The upper horizontal groove accommodates optionally a plurality of accessories which will hereafter be described, such as a cover, a dome, a decorative or protective strip, etc. No additional fastening means such as screws, bolts, clamps, etc. are required to secure the coping in position on the pool. Facing the pool interior, the coping is contoured to form a convex shape or rounded corner and comprises the junction of the vertical wall and the horizontal deck. To prevent buckling or distortion of the rounded corner, especially where the coping bends substantially, a yoke may be inserted and, with the locking feature provided, interlocked inside the top of the coping. A leveling element to keep contiguous coping sections may be inserted into and also locked in place within the coping recess. The side of the coping, facing the outside of the pool, contiguous to the top of the coping is open to allow concrete, which is poured to form the deck around the pool, to flow into the cavity at the top of the coping thereby more securely retaining the coping in position. Optionally, a stiffening outwardly extending arm, formed so as to be clamped on the coping and embedded in the contiguous concrete deck, may be locked on the coping.

BRIEF DESCRIPTION OF THE DRAWING

The invention will be more fully understood from the following detailed description in conjunction with the several illustrative figures of the accompanying drawing in which:

FIG. 1 is a fragmentary perspective view, partly in cross section of an exemplary installation of a coping of the present invention showing the bead of a pool liner in the lower channel and no accessory in place in the upper channel.

FIG. 2 is a cross sectional view of the coping of the present invention illustrating the vertical installation groove, the two horizontal accessory accommodating horizontal channels and the locking, i.e. toothed elements for the distortion preventing inserts.

FIG. 3 is a fragmentary cross sectional view illustrating the pool liner with the pool liner retaining bead in the lower horizontal groove of the coping and the retaining bead of a pool cover in the upper horizontal groove.

FIG. 4 is a fragmentary cross sectional view of the coping illustrating a fluid containing conduit in the upper horizontal groove of the coping.

FIG. 5 is a perspective of a suitable stiffening yoke employable in conjunction with the coping of the invention.

FIG. 5A is a cross sectional view of the coping shown in conjunction with the stiffening yoke of FIG. 5 inserted in the upper contoured portion of the coping and engaged with the interlocking elements formed on the coping.

FIG. 6 is a cross sectional view similar to FIG. 3 of an alternate embodiment in which the upper horizontal groove of the coping is utilized to hold the bead of a protective depending skirt that covers the lower groove and preferably also extends below the water surface.

FIG. 7 illustrates the use of the upper horizontal groove of the coping of the present invention to house a decorative strip and/or lighted, e.g. fiber optics element.

DETAILED DESCRIPTION OF THE INVENTION

Figure 8:
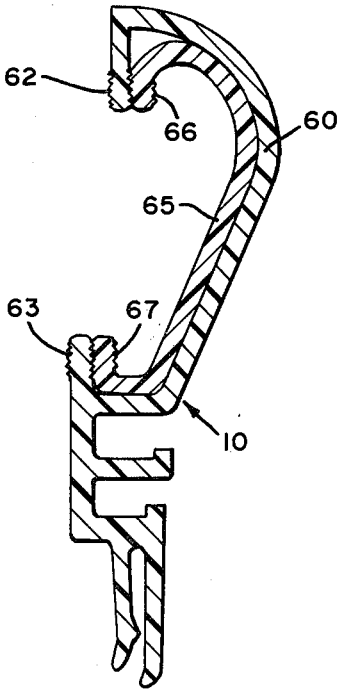
FIG. 8 is a cross sectional end view taken along line 8—8 of FIG. 8A.

The particular features of the present invention are set forth in detail in the drawing. As shown in FIG. 1, a coping member 10 is mounted at the top 12 of a typical swimming pool wall 14. An upper portion 16 of the coping member 10 comprises a convex shaped outer surface 18 facing the interior of the pool and blending into a deck 20 generally comprising poured concrete 21.

A lower portion 22 of the coping 10 includes, as an integral part an open-ended downward facing vertical channel or groove 24 for receiving the top edge 12 of the wall 14, and a pair of open-ended horizontal channels, a lower channel 26 preferably having a raised lip 27 to secure and retain a bead 28 of a pool liner 29 and an upper horizontal channel 30 (FIG. 2), also, preferably with a retaining lip 31 in which a variety of inserts may be retained as described hereinafter.

The pool deck 20 is preferably poured concrete 21 having any desired thickness and is supported by any suitable means such as back-filled earth **21*a* and a conventional suitable bracing system (Not shown). The inner edge of the concrete is confined by the inner surface 17 of the upper portion 16 of the coping 10 where the reinforcing yoke 11 is used, as shown in FIG. 5A, the poured concrete surrounds and embeds the yoke 11** when required.

The coping is conveniently shaped to have a bifurcated lower end comprising a pair of depending legs 34 and 35 which straddle the top of the pool wall 14 that supports the coping 10, with the leg 34 is on the outside of the pool wall and leg 35 on the inside. Preferably a restricted portion 37 is formed in the groove 24 to enhance the grip of the coping 10 when it is slipped on the top 12 of the pool wall 14.

An important feature of the coping of the present invention resides in the location of the bifurcated depending legs 34 and 35 in the construction of the coping such that the conventional cantilever or overhang of the horizontal groove openings is essentially eliminated or is minimal. As shown by reference to FIG. 3, the securing bifurcated part comprising groove 24 of the coping 10 is positioned to the right of the center line of the coping. With this structure, the downward facing groove 24 is located so that the mouth of the lower horizontal channel 26 which accommodates the retaining bead of the swimming pool liner 29, falls in a vertical plane which is substantially contiguous to the pool wall 14. This has the effect of avoiding bulging of the liner 29 at the top between the exit of the horizontal channel 26 (which holds the liner bead 28) and the point at which water pressure presses the liner 29 against the pool wall, see also FIG. 6, and presents a more "tailored" less wrinkled appearance at the readily visible upper portion of the liner area.

Another advantage of the coping of the invention resides in means to avoid buckling or unevenness of the coping at the top and upper front portion 16 which occurs when the coping is required to bend excessively in conforming to the contour of various special shaped pools. Since the cross sections of the coping wall must not be so thick that it precludes the coping from being curved to conform to the contour of the pool, this "lack" of sufficient wall thickness produces significant deformation at or near the top or crown 16 of the coping; the amount of this deformation depends on the extent of the bending of the coping to conform to the pool shape.

In accordance with the invention, this deformation is prevented by inserting a stiffening yoke at appropriate points in the curved portions of the coping. This is shown more clearly by reference to FIGS. 5 and 5A. As shown, a yoke 11 which is of a suitable width such as one to three inches, and whose shape is essentially a double ended bifurcated configuration containing upper legs **46*a* and 46*b* and lower legs 47*a* and 47*b* and a central slender portion 15, may be inserted in the coping. The yoke 11 when positioned in place on the coping 10 provides the desired rigidity and mechanism to prevent any significant buckling of the coping. To prevent the displacement of the yoke 11 once it has been inserted in the cavity 44, a series of teeth 46*c* and 46*d* (FIG. 5) are provided on the inner sides of the upper part of the yoke 11 which mesh with corresponding teeth 48*a* and 48*b* on the upper rear part 48 of the coping 10 and the teeth 49*a* and 49*b* on the lower rear part 49 of the coping cavity mesh with the corresponding set of teeth 47*c* and 47*d* of the yoke 11**.

An advantage of the coping of the invention resides in the fact that the cross sectional configuration of the coping member 10 is such that the coping lends itself to fabrication by extrusion or it may be otherwise molded from any suitable rigid or semi rigid material including metal, e.g. aluminum, but preferably it is formed from a synthetic resinous composition, either thermoplastic or thermosetting, such as a high impact rigid polyvinyl chloride, or a polyolefin, e.g. polyethylene or polypropylene, nylon, polycarbonate, glass reinforced nylon or polyester, and the like. The coping can be provided in any suitable practical length.

Another important feature of the invention resides in the fact that the novel cross-sectional design of the coping permits it to be used with all desired swimming pool contours. By choice of compositions, and by slightly rounding rectangular corners so that not less than a minimal dimension recommended by a particular design may be provided is used, the coping avoids the need for special pieces. For example, a recommended minimal radius in the order of 2 feet was determined in one particular design by pre-forming process.

The coping can be flexed substantially in either direction to accommodate curves of a concave-convex contour such as, for example, for kidney-shaped or other special shaped pools. The coping of the present invention thus lends itself to construction of round pools, oblong pools and a wide variety of shapes as desired.

In the embodiment depicted in FIG. 3, the coping is shown accommodating the bead 28 of a conventional pool liner 29 in the lower channel 26 while the upper channel 36 contains the bead 32 of a pool cover 33 which is used to prevent debris from falling into the pool when the pool is not in use and prevents unauthorized or accidental use such as by small children, for example.

In the embodiment of FIG. 4, the upper channel 30 of the coping 10 is illustrated housing a small conduit 40 through which water and/or pool treating chemicals may be introduced through openings 41 into the pool on command, or automatically, at predetermined intervals in facilitating pool maintenance. A water spray effect 42 from the conduit 40 may also be used to provide an attractive aesthetic effect.

In the embodiment illustrated in FIG. 6, the lower channel 26 is used to hold the bead 28 of the pool liner while the upper channel 30 serves as a securing means for a bead 32*a* or other securing element which holds an accessory such as the protective panel or skirt or drape 51 which improves the aesthetic appearance and protects the upper part of the liner 28 against sharp objects or other abuse as well as affording a shade of the above the water line part of the plastic pool liner against the degrading ultra violet light effects of the sun's rays on the liner.

In the embodiment of FIG. 7, the upper channel 30 is shown accommodating the holding means 54 for a decorative strip 55. The strip 55 may be flexible or rigid and may contain any desired decorative or written information 56 on the surface facing the interior of the pool, e.g. an imprinting of the pool depth at that location. Additionally, the insert 55 may contain lights (not shown) of a conventional kind or the fiber optics variety of illumination.

Figure 8A:
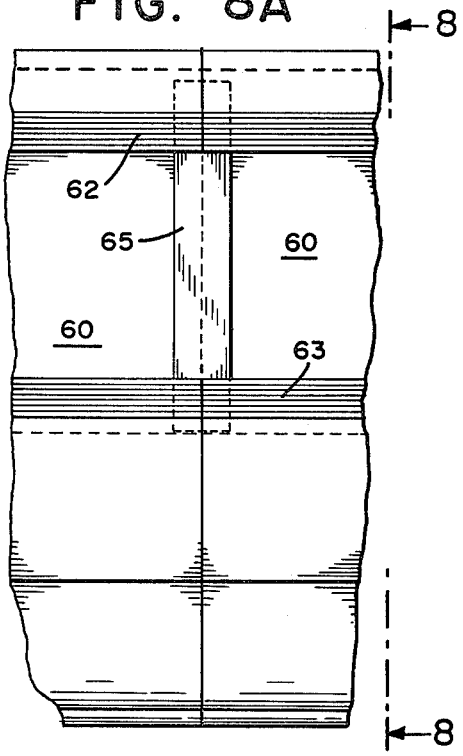
FIG. 8A is a fragmentary back view of the coping of the invention with a coupling insert which interlocks in alignment two adjoining coping setments.

As shown in FIGS. 8 and 8A, an adapter to maintain adjoining sections of the coping in alignment is provided. This piece in the interior of the coping cavity bridges the connecting seam between two contiguous coping segments.

As seen in FIGS. 8 and 8A the piece or adapter 65 which conforms to the shape of the inside of the cavity of the upper part 60 of coping 10 and has a suitable width of about 1 to 12 inches is inserted into the cavity at the seam and held in place by interlocking elements such as teeth 66 and 67, formed on the insert, which mesh with corresponding upper and lower elements 62 and 63 respectively on the coping 10 to maintain an even unbroken coping surface alignment.

Figure 9:
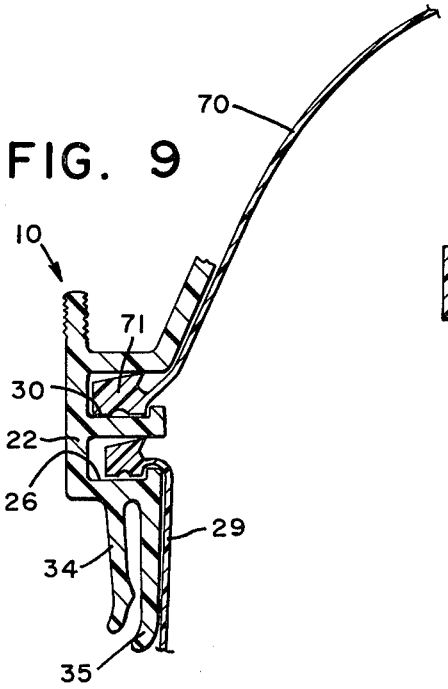
FIG. 9 is a cross sectional fragmentary view of the coping of the invention showing a vinyl liner bead segment positioned in the lower horizontal groove and the bead of a dome or enclosure which is supportable by air pressure and allows use of the pool in inclement weather, fitted into the upper horizontal groove.

In the embodiment of FIG. 9, a retaining element 71 to hold a pool dome 70 of the kind which is supported by low pressure air is illustrated as secured in the upper channel 30 with the convention liner bead for the pool liner 29 secured in the lower channel. Such domes or enclosures increase the number of days during which the pool is usable, i.e. the use of the swimming pool is extended by allowing the pool to be heated and to be sheltered against inclement weather.

Figure 10:
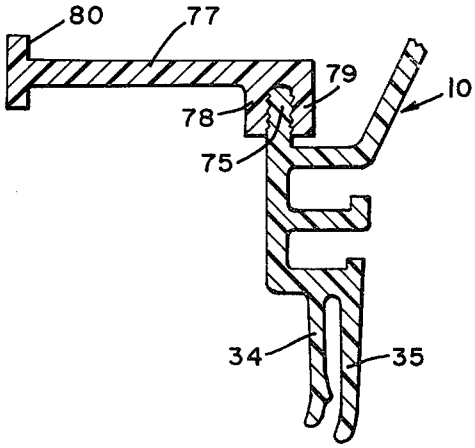
FIG. 10 is a cross sectional view showing a fragment of the coping of the invention with an outwardly extending anchoring element which is locked to the coping and functioning to be embedded in the contiguous concrete deck to lend additional stability to the structure.

An anchoring element to further secure the coping 10 in the installation is illustrated in FIG. 10. As shown, the horizontal element 77, having a suitable width, in the order of about one to four inches, and provided with gripping means 78 and 79 which interlock with mating gripping means on the coping cavity extension 75, referred to as 49*a* and 49*b* in FIG. 2, serves as an additional anchor for the coping. The anchor, the entirety of which is embedded in poured concrete, as would be apparent by reference to FIG. 1, may be provided with one or more cross members 80 which enhance the hold of the anchor in the concrete.

While the preferred embodiments of the invention have been disclosed in detail, it is to be understood that various alternative details or equivalents which fall within the scope of the invention as claimed may be adapted by those skilled in the art.

What is claimed is:

1. A swimming pool coping for use on a swimming pool, wherein said swimming pool includes a vertical pool wall and a horizontal deck, said coping comprising a unitary member having the following integral parts:

A. a bifurcated body member defining a downward facing groove which is adapted to be positioned around the periphery of a swimming pool and to receive the top of the swimming pool wall within said groove, B. A rounded contoured top portion formed as an integral extension and disposed vertically above said body member, said top portion, upon installation of the coping on the swimming pool comprising a transitional corner element between the vertical wall of said pool and the horizontal deck of said pool, said top portion having a horizontal cavity facing the deck of said pool and arranged to receive poured concrete therein, and C. an upper horizontal channel and an independent lower horizontal channel opening to a pool interior, the said lower channel accommodating a retaining bead of a swimming pool liner and wherein the mouth of the lower horizontal channel falls in a vertical plane which is substantially contiguous to the vertical pool wall on which said coping is installed.

2. A coping according to claim 1 characterized by means to hold a yoke in interlocked engagement within said cavity, and a yoke in interlocked position in said cavity to prevent distortion of the coping.

3. A coping according to claim 1 provided with an adapter which fits into and is interlocked within the cavity of the coping between two contiguous coping sections to retain said sections in alignment.

4. A coping according to claim 1 wherein said contoured top segment is formed so as to overhang horizontally within the pool beyond the vertical pool wall.

5. A coping according to claim 1 wherein the contoured top is provided with interlocking upper and lower elements to accommodate a stiffening yoke and a double ended yoke comprising an upper bifurcated locking end and a lower bifurcated locking end which interlock, respectively, with said upper and lower elements.

6. The coping according to claim 1 provided with a substantially horizontal anchoring element which locks in said cavity and extends outwardly from said coping.

7. A coping according to any of the preceding claims which is formed of synthetic resinous composition.

8. The coping according to claim 1 in combination with decorative trim secured in the upper channel.

9. The coping according to claim 1 in combination with a pool dome secured in the upper channel.

10. The coping according to claim 1 in combination with lighted strip secured in the upper channel.

11. The coping according to claim 1 in combination with a protective skirt secured in the upper channel.

12. The coping according to claim 1 in combination with a pool protective cover in the upper channel.

* * * * *